United States Patent [19]

Uitto et al.

[11] Patent Number: 5,000,271

[45] Date of Patent: Mar. 19, 1991

[54] FEEDING DEVICE FOR A ROCK DRILLING MACHINE

[75] Inventors: Vesa Uitto, Tampere; Veijo Nurmi, Ylojarvi; Ossi Tienari, Kilvakkala, all of Finland

[73] Assignee: Oy Tampella AB, Tampere, Finland

[21] Appl. No.: 376,843

[22] Filed: Jul. 7, 1989

[30] Foreign Application Priority Data

Jul. 12, 1988 [FI] Finland ..... 883312

[51] Int. Cl.[5] ..... E21B 15/04

[52] U.S. Cl. ..... 173/39; 173/42; 175/113

[58] Field of Search ..... 173/28, 39, 42, 43, 173/44; 175/153, 202, 220

[56] References Cited

U.S. PATENT DOCUMENTS

| | | | |
|---|---|---|---|
| 4,601,000 | 7/1986 | Montabert | 173/43 X |
| 4,785,892 | 11/1988 | Luen | 173/39 X |
| 4,848,485 | 7/1989 | Piipponen et al. | 173/13 X |

FOREIGN PATENT DOCUMENTS

| | | |
|---|---|---|
| 470610 | 7/1975 | U.S.S.R. . |
| 62503 | 8/1978 | U.S.S.R. . |
| 681185 | 8/1979 | U.S.S.R. . |
| 899903 | 1/1982 | U.S.S.R. . |
| 1406368 | 6/1988 | U.S.S.R. . |

*Primary Examiner*—Frank T. Yost
*Assistant Examiner*—Willmon Fridie, Jr.
*Attorney, Agent, or Firm*—Ladas & Parry

[57] ABSTRACT

A feeding device for a rock drilling machine (3) comprising a cradle (1); and a feeding beam (2) mounted longitudinally displaceably with respect to the cradle (1), the drilling machine (3) being displaceable along the feeding beam. Displacing means comprise a chain (6) forming a closed loop, being arranged to move around turning wheels (4, 5) provided at both ends of the feeding beam (2), and connected stationary with respect to the drilling machine (3). The drilling machine (3) is arranged to be connected stationary with respect to the feeding beam (2) over its whole range of movement relative to the feeding beam (2) and the feeding beam (2) with respect to the cradle (1) over its whole range of movement relative to the cradle (1).

8 Claims, 1 Drawing Sheet

FEEDING DEVICE FOR A ROCK DRILLING MACHINE

Figure 1:
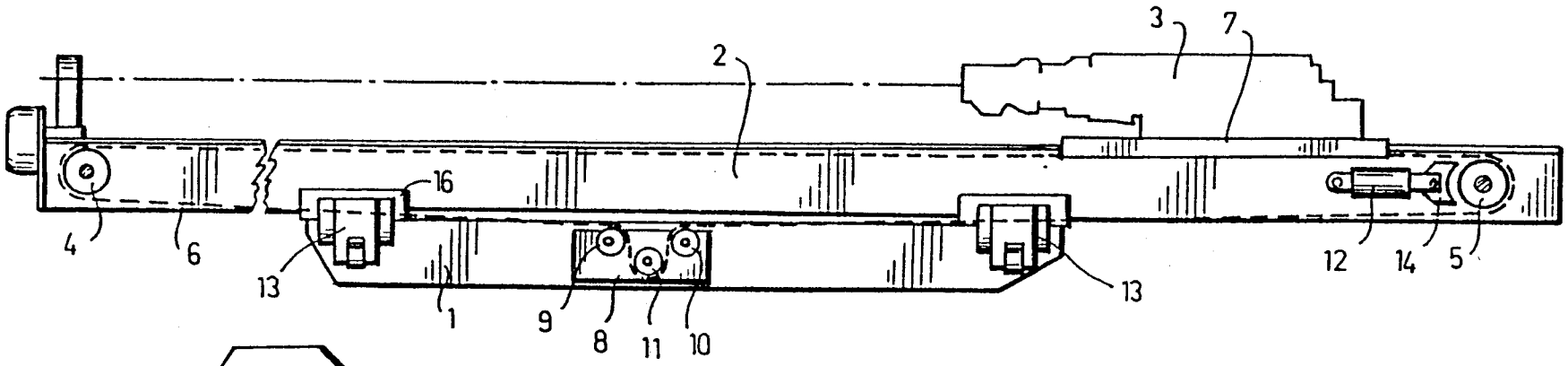

The invention relates to a feeding device for a rock drilling machine, comprising a cradle to be mounted in the end of a boom; a feeding beam mounted longitudinally displaceably with respect to the cradle, the drilling machine being displaceable along the feeding beam; displacing means for displacing the feeding beam with respect to the cradle and for displacing the drilling machine with respect to the feeding beam, the displacing means comprising an elongated flexible displacing member forming a substantially closed loop and arranged to move in its longitudinal direction around turning wheels provided at both ends of the feeding beam, and a displacing mechanism arranged to move the displacing member in its longitudinal direction; connecting means for connecting the drilling machine stationary with respect to the feeding beam in at least one position of the drilling machine relative to the feeding beam for displacing the feeding beam with respect to the cradle during the movement of the displacing member and correspondingly for connecting the feeding beam stationary with respect to the cradle in at least one position of the feeding beam relative to the cradle for displacing the drilling machine with respect to the feeding beam during the movement of the displacing member, one and the same displacing member and one and the same displacing mechanism being used for the displacement of the drilling machine along the feeding beam and for the displacement of the feeding beam with respect to the cradle.

In prior art feeding devices for rock drilling machines, the feeding beam is mounted longitudinally displaceably in a cradle while the rock drilling machine is mounted on the feeding beam displaceably in the longitudinal direction of the feeding beam. In prior art solutions, a separate feeding device is provided for each displacing movement, whereby the rock drilling machine is typically displaced by means of a chain which goes around wheels mounted at the ends of the feeding beam and the ends of which are fastened to the drilling machine. The chain is moved by a displacing mechanism mounted in the feeding beam. The feeding beam, in turn, is displaced with respect to the cradle by means of a pressure medium cylinder mounted between it and the cradle. A solution of this type is disclosed in German Offenlegungsschrift 30 15 752, for instance.

A drawback of the solution described above is that both displacing movements require separate drive and power devices with resultant extra weight at the end of the drill boom. As a consequence, the boom has to be constructed more steady than what would the required otherwise, and the control of the boom requires strong drive and power devices. The solution requires separate pressure medium hoses for both displacing means in cases where the power devices are pressure medium operated. Moreover, the solution is complicated and expensive.

The object of the present invention is to provide a feeding device in which the structure carrying out the displacing movements is as simple as possible and which is lighter than the prior art solutions as well as simpler to realize and avoids the drawbacks mentioned above. This is achieved according to the invention in such a manner that the drilling machine is arranged to be connected by means of the connecting means stationary with respect to the feeding beam substantially over the whole range of movement of the drilling machine relative to the feeding beam and that the feeding beam is arranged to be connected stationary with respect to the cradle by means of the connecting means substantially over the whole range of movement of the feeding beam relative to the cradle.

The basic idea of the invention is that the movement between the cradle and the feeding beam as well as the movement between the drilling machine and the feeding beam are effected by means of one and the same chain or wire rope operated member for displacing the drilling machine, and a displacing mechanism. In order to obtain a desired movement, the drilling machine is connected stationary with respect to the feeding beam so that the feeding beam is displaceable with respect to the cradle, or the feeding beam is connected stationary with respect to the cradle so that the drilling machine is displaceable with respect to the feeding beam. An advantage of the invention is that both displacing movements can be effected by means of one and the same displacing means, whereby the other displacing means and the devices required by it can be omitted so that the weight of the feeding beam and the components attached thereto is remarkably smaller. The solution according to the invention also provides savings in maintenance and repair costs, because spare parts and components are needed for one displacing mechanism only. Furthermore, the displacing movement of the feeding beam is longer than previously, because the cylinder length does not restrict the maximum length of the displacing movement.

Figure 2:
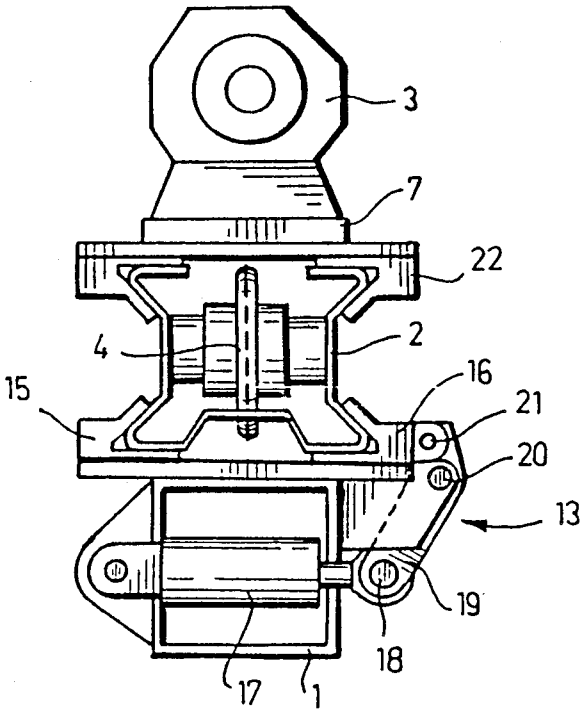

The invention will be described in greater detail in the attached drawings, wherein FIG. 1 is a schematical view of a feeding device of the invention with its displacing means; and FIG. 2 is a more detailed view of a solution for locking the feeding beam stationary with respect to the cradle.

FIG. 1 shows a feeding device for a rock drilling machine. The feeding device comprises a cradle 1 to be mounted in the end of a boom known per se (not shown); a feeding beam 2 longitudinally displaceable with respect to the cradle 1; and a rock drilling machine 3 displaceable with respect to the feeding beam 2 in the longitudinal direction thereof. Sprocket wheels 4 and 5 act as turning wheels at the ends of the feeding beam 2, and a chain 6 goes around the wheels. The chain 6 forms a closed loop, being attached at the ends to the drilling machine 3 or, more generally, to a sledge 7 used as a carrier for the drilling machine. Alternatively, the chain may itself form a closed loop attached at one point to the drilling machine 3 or to the sledge 7 so as to be stationary in the longitudinal direction. As used in the present patent application and claims, the expression "substantially closed loop" refers to all the alternatives mentioned above, irrespective of whether they are realized with a chain, a wire rope or any other flexible displacing member. The expression "one and same displacing member", in turn, refers to one or more chains, wire ropes or the like members moving along substantially the same path side by side with each other and driven by the same displacing mechanism.

The chain 6 passes via a driving mechanism 8 mounted in the cradle 1. The driving mechanism 8 comprises control wheels 9 and 10 and a drive wheel 11 connected to a driving motor known per se (not shown). When the drive wheel 11 is rotated by means of the driving motor in either direction, the chain 6 moves in the longitudinal direction of the cradle 1 and correspondingly tends to turn around the turning wheels 4 and 6 and to move in the longitudinal direction of the feeding beam 2. In this situation, it can be decided whether it is the drilling machine 3 or the feeding beam 2 that is to be displaced simply by connecting either the drilling machine 3 stationary with respect to the feeding beam or the feeding beam 2 stationary with respect to the cradle 1. A connecting device 12 is provided at one end of the feeding beam 2 for locking the turning wheel 5 against rotation. As the turning wheel 5 is a sprocket wheel, the chain 6 cannot slide past the turning wheel but the sledge 7 and, accordingly, the drilling machine 3, are connected stationary longitudinally of the feeding beam 2. As the feeding beam 2 is able to move freely with respect to the cradle 1, the movement of the chain 6 longitudinally of the cradle 1 also causes the feeding beam 2 to be displaced longitudinally of the cradle 1 in the same direction as the chain 6.

When the drilling machine 3 is to be displaced along the feeding beam, the feeding beam 2 is correspondingly connected stationary with respect to the cradle 1 by means of a connecting device 13 while the sprocket wheel 5 is allowed to rotate freely. The chain 6 thereby moves around the turning wheels 4 and 5. During its movement with respect to the cradle 1 and the feeding beam 2 the chain displaces the drilling machine 3 on the other side of the feeding beam 2 to the opposite direction. In some cases, the drilling machine and the feeding beam can be displaced simultaneously simply by leaving both of them unconnected.

The connecting device 12 connecting the drilling machine stationary is a pressure medium cylinder mounted stationary in the longitudinal direction of the feeding beam 2. A brake shoe 14 is attached to the piston arm of the pressure medium cylinder for pressing the sprocket wheel 5 so that it cannot rotate.

FIG. 2 is a more detailed view of one embodiment of the connecting device 13 connecting the feeding beam 2 stationary with respect to the cradle 1. The feeding beam 2 moves with respect to the cradle 1 on slide pieces 15 and 16. The connecting device 13 comprises a pressure medium cylinder 17 which is mounted in a transverse direction with respect to the feeding beam 2. The piston of the cylinder 17 is connected pivotably by means of a shaft 18 to a pivoted lever 19 which, in turn, is connected pivotably with respect to the cradle 1 by means of a shaft 20. The slide piece 16 which is mounted displaceably in the transverse direction of the cradle 1 is connected pivotably to the pivoted lever 19 by means of a shaft 21. At the connecting stage, pressure medium is introduced into the pressure medium cylinder 17, whereby the piston pushes the pivoted lever 19 outward. While turning around the shaft 20, the pivoted lever pushes the slide piece 16 towards the opposite slide piece 15, wedging the feeding beam 2 between the surfaces of the slide pieces and causing it to stop due to friction. In place of a slide piece, a separate press member can be used which is connected to the pressure medium cylinder to be operated thereby.

FIGS. 1 and 2 show one embodiment of the invention, and the invention is by no means restricted to them, but it can be modified as desired within the scope of the claims. In place of the chain 6, any flexible displacing member can be used, such as a wire rope, cogged belt or other suitable component. The drilling machine can be connected stationary with respect to the feeding beam by means of the solution described above or by means of a mechanism locking the drilling machine or its sledge directly to the feeding beam, such as a mechanism of FIG. 2, which connects the feeding beam to the cradle, or by means of a mechanism locking the displacing member stationary directly with respect to the drilling machine. Instead of being connected indirectly, the chain or other flexible member can be connected directly to the feeding beam by means of a suitable connecting member. Correspondingly, the feeding beam can be connected stationary with respect to the cradle by means of various alternative ways of connection. In the solutions described, the connecting means can be mounted by means of a spring in such a manner that they are constantly at the connection position, and can be released by feeding pressure medium into the pressure medium cylinders so as to withdraw the piston from the connecting position. Similarly, the connecting means can be spring-loaded so that they are not locked but can be connected separately or simultaneously by feeding pressure medium into the cylinders. Instead of mounting the displacing mechanism in the cradle, it can also be mounted in the feeding beam or in connection with the drilling machine. If the displacing mechanism is mounted in connection with the drilling machine, it operates similarly as in the above-described embodiment. If the displacing mechanism is mounted in the feeding beam, the locking cannot be effected between the drilling machine and the feeding beam or between the feeding beam and the cradle, but the displacing member has to be connected stationary directly with respect to the drilling machine or the cradle when they are displaced.

What is claimed is:

1. A feeding device for a rock drilling machine (3), comprising a cradle (1) to be mounted in the end of a boom; a feeding beam (2) mounted longitudinally displaceably with respect to the cradle (1), the drilling machine (3) being displaceable along the feeding beam; displacing means (4 to 6, 8 to 10) for displacing the feeding beam (2) with respect to the cradle (1) and for displacing the drilling machine (3) with respect to the feeding beam (2), the displacing means (4 to 6, 8 to 10) comprising an elongated flexible displacing member (6) forming a substantially closed loop and arranged to move in its longitudinal direction around turning wheels (4, 5) provided at both ends of the feeding beam (2), and a displacing mechanism (8 to 10) arranged to move the displacing member (6) in its longitudinal direction; connecting means (12, 14; 13 to 21) for connecting the drilling machine (3) stationary with respect to the feeding beam (2) in at least one position of the drilling machine (3) relative to the feeding beam (2) for displacing the feeding beam (2) with respect to the cradle (1) during the movement of the displacing member (6) and correspondingly for connecting the feeding beam (2) stationary with respect to the cradle (1) in at least one position of the feeding beam (2) relative to the cradle (1) for displacing the drilling machine (3) with respect to the feeding beam (2) during the movement of the displacing member (6), one and the same displacing member (6) and one and the same displacing mechanism (8 to 10) being used for the displacement of the drilling machine (3) along the feeding beam (2) and for the displacement of the feeding beam (2) with respect to the cradle, characterized in that the drilling machine (3) is arranged to be connected stationary with respect to the feeding beam (2) by means of the connecting means (12, 14) substantially over the whole range of movement of the drilling machine (3) relative to the feeding beam (2) and that the feeding beam (2) is arranged to be connected stationary with respect to the cradle by means of the connecting means substantially over the whole range of movement of the feeding beam (2) relative to the cradle (1).

2. A feeding device for a rock drilling machine (3) according to claim 1, characterized in that the connecting means (12, 14; 13 to 21) comprise a press member (13 to 21) mounted in the cradle (1) and arranged to press the feeding beam (2) so that it is stationary with respect to the cradle (1) at any point over the range of movement of the feeding beam (2) relative to the cradle (1).

3. A feeding device according to claim 2, characterized in that the connecting means (13, 16) comprise a pressure medium operated cylinder (17) arranged to act on the feeding beam (2) in its transverse direction by means of the press member so that the force exerted by the cylinder (17) presses the feeding beam (2) at the connecting stage against at least one slide piece (15) disposed on one side of the beam, clamping the feeding beam (2) between the press member and the slide piece (15, 16) so that it is stationary with respect to the cradle (1).

4. A feeding device according to claim 1 characterized in that the connecting means (12, 14) comprise a pressure medium operated cylinder connected to the drilling machine (3) and arranged to act on the feeding beam (2) in its transverse direction by means of the press member so that the force exerted by the cylinder (17) presses the feeding beam (2) at the connecting stage against at least one slide piece disposed on one side of the beam and connected to the drilling machine, clamping the feeding beam (2) between the press member and the slide piece, thus connecting the drilling machine stationary with respect to the feeding beam (2).

5. A feeding device according to claim 1 characterized in that the displacing member (6) is a chain and that the means (12, 14) for connecting the drilling machine stationary with respect to the feeding beam (2) comprise a pressure medium operated cylinder (12) and a brake shoe (14) connected to the cylinder (12), the brake shoe (14) being arranged to connect the chain (6) stationary with respect to the feeding beam (2) at the connecting stage.

6. A feeding device according to claim 3 characterized in that the piston of the pressure medium cylinder (12; 17) is by means of a spring arranged to constantly connect the drilling machine (3) stationary with respect to the feeding beam (2) and/or the feeding beam (2) stationary with respect to the cradle (1) and that for displacing the drilling machine (3) and/or the feeding beam (2), both of them are arranged to be released simultaneously or separately so as to move freely by introducing pressure medium in the pressure medium cylinder (12; 17), respectively.

7. A feeding device according to claim 1 characterized in that the displacing mechanism (8 to 11) is mounted in the feeding beam (2) in such a manner that the displacing member (6) is movable with respect to the drilling machine (3) and the cradle (1) and that the connecting means (12, 14; 13 to 21) are arranged to connect the drilling machine (3) and the cradle (1), respectively, stationary with the displacing member (6).

8. A feeding device according to claim 1 characterized in that the displacing mechanism (8 to 11) is mounted in the cradle (1) or drilling machine (3), that the connecting means (12, 14; 13 to 21) are arranged to connect the drilling machine (3) stationary with respect to the feeding beam (2) and correspondingly the feeding beam (2) stationary with respect to the cradle (1), whereby the displacement of the feeding beam (2) with respect to the cradle (1) and the displacement of the drilling machine (3) with respect to the feeding beam (2) can be carried out alternately by means of one and the same displacing mechanism (8 to 11) and one and the same displacing member (6) by alternately connecting the drilling machine (3) stationary with respect to the feeding beam (2) and the feeding beam (2) stationary with respect to the cradle (1).

* * * * *